US010453334B2

(12) United States Patent
Barajas Gonzalez et al.

(10) Patent No.: US 10,453,334 B2
(45) Date of Patent: Oct. 22, 2019

(54) PREDICTIVE ANALYTICS TO DETERMINE OPTIMAL SPACE ALLOCATION

(71) Applicant: INTERNATIONAL BUSINESS MACHINES CORPORATION, Armonk, NY (US)

(72) Inventors: Emmanuel Barajas Gonzalez, Guadalajara (MX); Shaun E. Harrington, Sahuarita, AZ (US); Harry McGregor, Tucson, AZ (US); Christopher B. Moore, Vail, AZ (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 1030 days.

(21) Appl. No.: 14/923,883

(22) Filed: Oct. 27, 2015

(65) Prior Publication Data

US 2017/0116528 A1 Apr. 27, 2017

(51) Int. Cl.

| | |
|---|---|
| ***G08G 1/01*** | (2006.01) |
| ***G08G 1/04*** | (2006.01) |
| ***G08G 1/065*** | (2006.01) |
| ***G08G 1/14*** | (2006.01) |

(52) U.S. Cl.

CPC ..... *G08G 1/012* (2013.01); *G08G 1/0112* (2013.01); *G08G 1/0129* (2013.01); *G08G 1/0141* (2013.01); *G08G 1/04* (2013.01); *G08G 1/065* (2013.01); *G08G 1/144* (2013.01); *G08G 1/146* (2013.01)

(58) Field of Classification Search

None

See application file for complete search history.

(56) References Cited

U.S. PATENT DOCUMENTS

| | | | | |
|---|---|---|---|---|
| 7,049,979 | B2 * | 5/2006 | Dunning | G08G 1/14 340/932.2 |
| 9,547,988 | B2 * | 1/2017 | Moore | G01C 21/3685 |
| 2005/0096974 | A1 * | 5/2005 | Chagoly | G08G 1/14 705/13 |
| 2012/0265434 | A1 | 10/2012 | Woodard et al. | |
| 2013/0132102 | A1 | 5/2013 | Andrade et al. | |
| 2013/0179383 | A1 * | 7/2013 | Pringle | G06N 5/02 706/46 |
| 2013/0262059 | A1 * | 10/2013 | Grbovic | G06Q 10/04 703/6 |

(Continued)

OTHER PUBLICATIONS

Ashok et al., "A Novel Parking Solution for Metropolitan Parking Garages", Feb. 2015, Reasearch Gate, pp. 153-159 (Year: 2015).*

(Continued)

*Primary Examiner* — Paulinho E Smith

(74) *Attorney, Agent, or Firm* — Griffiths & Seaton PLLC

(57) ABSTRACT

Embodiments for management of a parking facility by a processor. Operations are performed to collect and track data of the parking facility over time from a plurality of sources including data representative of physical use of the parking facility and data obtained aside from the physical use data. Predictive analytics are applied to a totality of the physical use and other data to generate decisions that are implemented for the parking facility. The decisions anticipate individual behavior pertaining to the parking facility.

18 Claims, 5 Drawing Sheets

(56) References Cited

U.S. PATENT DOCUMENTS

| | | | | |
|---|---|---|---|---|
| 2014/0266800 | A1* | 9/2014 | Koukoumidis | G08G 1/141 340/932.2 |
| 2014/0302875 | A1* | 10/2014 | Beaurepaire | G08G 1/143 455/456.3 |
| 2014/0313058 | A1* | 10/2014 | Chen | G08G 1/141 340/932.2 |
| 2015/0009047 | A1* | 1/2015 | Ashkenazi | G08G 1/144 340/932.2 |
| 2015/0088790 | A1* | 3/2015 | Chidlovskii | G06Q 30/0202 706/12 |
| 2015/0123818 | A1* | 5/2015 | Sellschopp | G01C 21/3484 340/932.2 |
| 2015/0130638 | A1 | 5/2015 | Bahgat et al. | |
| 2016/0196747 | A1* | 7/2016 | Tsyrklevich | G08G 1/143 701/532 |
| 2016/0247326 | A1* | 8/2016 | de Souza | H04L 67/306 |
| 2017/0067661 | A1* | 3/2017 | Barajas Gonzalez | G05B 15/02 |
| 2017/0092130 | A1* | 3/2017 | Bostick | G08G 1/143 |
| 2017/0116528 | A1* | 4/2017 | Barajas Gonzalez | G08G 1/012 |

OTHER PUBLICATIONS

Klappenecker et al., "Finding Available Parking Spaces Made Easy" pp. 243-249, Inspec, Ad Hoc Networks, vol. 12, 2014, Elsevier Science B.V., Netherlands.

Emmino, Nicolette, "Mobile app does the impossible—locates open parking spaces on crowded city streets", Dec. 6, 2012, 3 pages.

* cited by examiner

PREDICTIVE ANALYTICS TO DETERMINE OPTIMAL SPACE ALLOCATION

BACKGROUND OF THE INVENTION

Field of the Invention

The present invention relates in general computing systems, and more particularly to, various embodiments for management and coordination of various operations of a parking facility.

Description of the Related Art

Parking structures are a common necessity for all areas expecting mass visitation, whether it be a downtown shopping area, an amusement park, or simply an apartment complex. The increasing frequency of large events, persons living in high density living arrangements, and overall increasing complexity of our society at large have led to an increase in the number and size of these parking structures.

SUMMARY OF THE INVENTION

Various embodiments for management of a parking facility by a processor are provided. In one embodiment, by way of example only, a method for management of a parking facility by a processor is provided. Operations are performed to collect and track data of the parking facility over time from a plurality of sources including data representative of physical use of the parking facility and data obtained aside from the physical use data. Predictive analytics are applied to a totality of the physical use and other data to generate decisions that are implemented for the parking facility. The decisions anticipate individual behavior pertaining to the parking facility.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE DRAWINGS

Figure 1A:
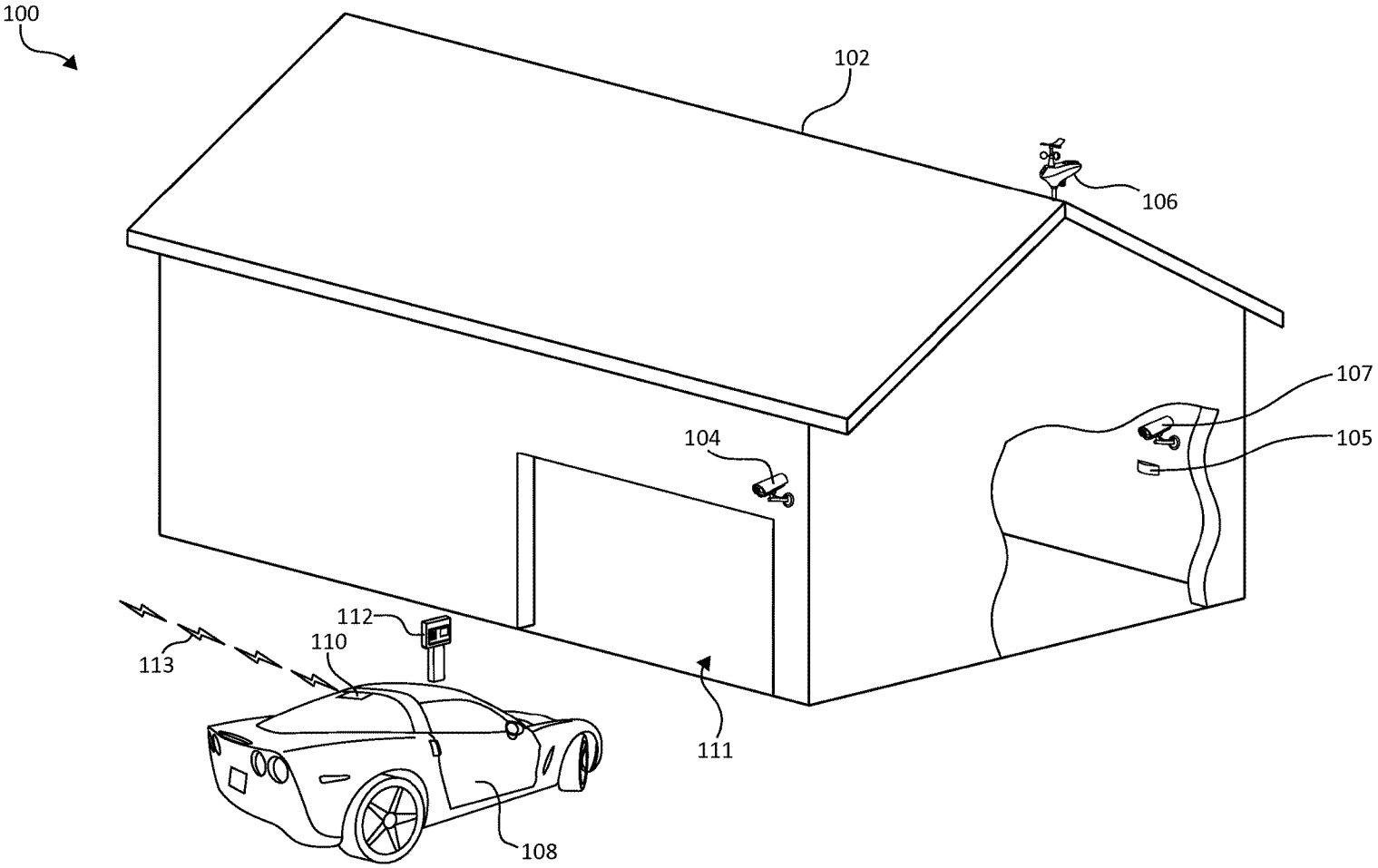
FIG. 1A is an illustration of a portion of a monitored parking facility, in communication with various data input, data processing and computing components, in which various aspects of the present invention may be realized.

As previously mentioned, parking facilities, garages, structures and other places where vehicles are stored, either temporarily, or on a more permanent basis, are ubiquitous in today's society, and their number and associated size continues to increase. While the size of parking structures has increased, other facets about such structures have not been changed or modernized.

Accordingly, when a person/vehicle pulls into such a parking facility, they typically do as they have always done, which is to queue in a line of vehicles, wait their turn, take generally the first parking opening, and so forth. When the same person leaves, typically the same scenario occurs, as people queue in a line, wait for their time to exit, and follow the line of vehicles to the exit.

In light of the typical parking and exit scenarios described above, there typically is not a consideration of where the individual is going, how long they intend to be parked in the facility, nor is there a consideration of various efficiencies to be gained by leveraging information. In most cases, individuals/vehicles arrive randomly at a parking facility and "hope for the best."

Accordingly, a need exists for mechanisms whereby the management operations of a typical parking facility may be more efficiently implemented, such that individuals using such parking facilities reap benefits of saving time, money, and added convenience, and the costs of operations of such parking facilities might be reduced, while at the same time maximizing occupancy rates and so forth.

To address these needs, the mechanisms of the illustrated embodiments provide avenues for using information from multiple data sources, including personal smart devices, physical location information, and social media, to assist individuals with navigating, and owners with managing, various parking operations within a parking facility, as will be further described. The mechanisms of the illustrated embodiments draw upon a wide variety of data inputs. In one example, these mechanisms may draw from the information typically stored within a smart device, such as calendar entries, GPS location data, social media entries, and search patterns among others, to then anticipate individual user behavior as it pertains to a particular parking structure.

Accordingly, the mechanisms of the illustrated embodiments collect data in order to study individual behavior and anticipate such behavior as its pertains to a particular parking structure. These behaviors can range from when the individual will most likely leave, what exit/entrance is best for the individual to utilize, to which specific parking spot would be optimal for both the individual and efficiency of the parking facility. In one embodiment, for example, the individual's location to be filled in the parking facility (physical location), as well as the individual's desired location for a parking spot may be taken into account. This exemplary scenario may come into play when the individual desires, for example, to be in close proximity to a specific location in the facility (e.g., close to an airline terminal/gate, or a specific ride or attraction). Using these variety of data sources, the mechanisms of the illustrated embodiments then are able to generate various decisions that promote efficiencies for the parking facility while meeting the needs of the individual users.

As previously mentioned, the mechanisms of the illustrated embodiments employ a data collection function to obtain a variety of related data from a variety of data sources for consideration. In one embodiment, data gleaned from calendar entries and social media events that involve appointments, flights, or any event that may indicate a user location change may be studied. In another embodiment, data representative of the physical use of the parking facility, such as average parking facility utilization using closed-circuit television (CCTV), ticket counting, or any other conceivable method for performing such data collection tasks as monitoring a number of vehicles in the facility, times entering and leaving the facility, specific locations, and the like, may be studied.

Additional data points may be studied in further embodiments, such as tracking local weather conditions, examining historical parking facility utilization over time, noting various preferred parking locations, nearby traffic history and/or current traffic conditions, particularly in view of past, current, or future events that may shape the traffic flow, such as construction events, social events in the immediate area, and hours of operation of nearby attractions, may all be collected and studied.

In further embodiments, additional data points such as search history (for example, data obtained from an individual user's mobile device(s), the types, sizes, and other physical characteristics of the vehicles themselves, various national, state, local, school, and other similar holiday schedules, and so forth, may be studied according to the mechanisms of the present invention.

In addition to the data collection function offered by the mechanisms of the illustrated embodiments, a data analytics function is performed, as will be further described. The data analytics function includes predictive analytics functionality, such that each of the collected data points are first organized, studied and compared over time, and then various predictive decisions are generated therefrom.

In one exemplary embodiment, analytics may be applied to take into account a total parking capacity in the facility. Upon capturing this information, the preferred parking location of regular occupants may be taken into account, and predictive analytics may be performed, specifically with the intention of determining the necessary parking layout and fill pattern for a particular parking facility while factoring in load balancing and other physical requirements of the structure.

In an additional embodiment, predictive analytics may be applied to anticipate parking facility utilization based on past trends of similar occupancy and outside environments (with their accompanying typical local usage concentrations or expected events) to ensure that the proper parking space allocation to best handle the particular expected usage is determined.

As one of ordinary skill in the art will appreciate, occupants and parking facility owners may have utilization and location requirements that may vary significantly. By collecting a solid foundation of data from a variety of sources, including information on consumption of the facility (e.g., utilization rates), various changes may be made to the facilities, loading, and layout, for example, to direct vehicles entering the facility to the optimal location for both the occupant(s) of the vehicles and the owner of the parking facility. For example, if a driver has an appointment in their calendar for lunch at a specific restaurant, the facility may coordinate with the driver's vehicle and/or smart device (such as an application installed on their telephone) to direct the driver to a parking location that is near an exit that is geographically proximate to the restaurant's location. A wide variety of assistance may be provided to the user such that the needs of the user are met, while also promoting various efficiencies of operation in the parking facility.

In one embodiment, weather forecast information may be used to assist with predictive parking structure usage as both good or inclement weather may change the individual behaviors of drivers. For example, if the weather is colder than the historical data indicates, the weather information may be used to adjust and plan for lower expected occupancy during these periods. Similarly, in a covered parking facility, for example, heavy rainfall may indicate to the facility that demand for covered parking locations may increase until the inclement weather subsides.

Various analytics, according to aspects of the present invention, may be performed on incoming occupants, such as their intended destinations for nearby attractions, the hours of operation of these attractions, as well as trending departure times based on the particular attraction being visited, to ensure that the appropriate layout of vehicles, facilities, and even the speedy departure of those vehicles from those parking structures are facilitated. For example, in the case of an amusement park parking scenario, a family with two children under the age of 10 most likely will depart the parking facility well before the park closes (e.g., at midnight).

Turning now to the Figures, FIG. 1 is an illustration of a portion 102 of an exemplary parking facility 100 in which aspects of the present invention may be implemented. Physical facility 100 has been equipped with a variety of sensors, cameras, entry monitoring devices, thermometers, and other data collection devices for the physical environment as will be further described.

While one of ordinary skill in the art will appreciate that other data collection devices may be installed and located in various locations in the facility 100, or elsewhere, the various data collection devices shown in physical facility 100 include sensors 105, cameras 104 and 107, and weather monitoring station 106. Entry 111 (e.g., garage door 111) is monitored by a CCTV camera 104 or similar device allowing for the determination of the number of cars entering and/or exiting the facility 100. In addition, a ticket dispenser 112 or other metering device is adapted for collecting data such as a time of entry. Weather station 106 may collect weather data such as barometric pressure, wind speed, precipitation, temperature, and other weather-related data.

A vehicle 108 is poised to enter the facility 100. A parking controller module 110 is integrated into the hardware of the vehicle 108 (and/or installed as software), and equipped (not shown for purposes of convenience) with various hardware components known to one of ordinary skill in the art to collect, process, and disseminate information (shown here as exemplary radio frequency communication protocol 113) between the vehicle 108 and the parking facility 100.

Sensors 105 and cameras 104 and 107 may be configured to monitor various physical characteristics in the parking facility such as a number of vehicles 108 entering or exiting, a number of vehicles 108 in a particular location, determine a vehicle type, size or weight, vehicle 108 direction, and so forth.

Figure 1B:
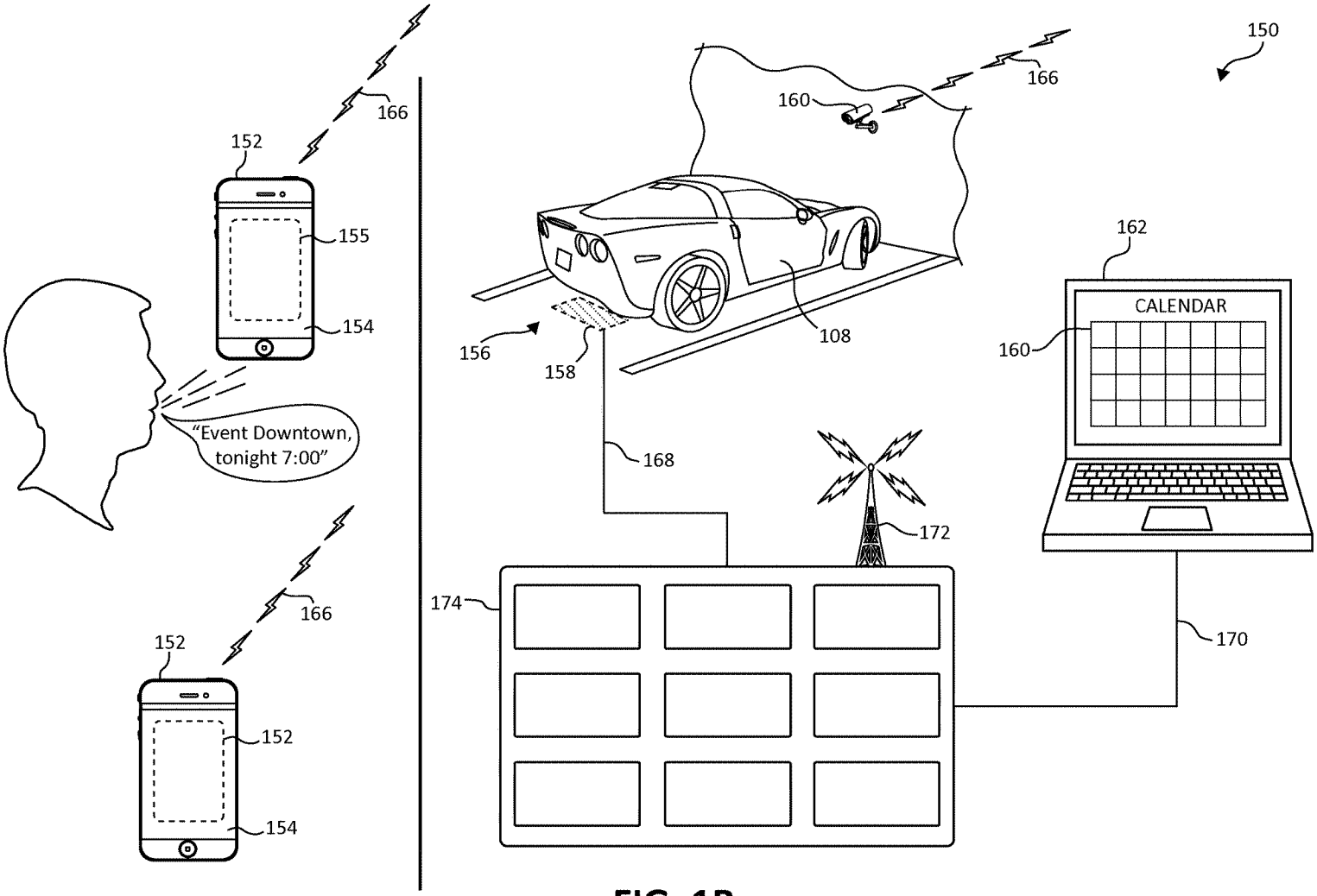
FIG. 1B is a continuation of various data input, data processing and computing components for management of a parking facility as first depicted in FIG. 1A previously.

Turning to FIG. 1B, additional hardware 150 for purposes of collecting data from the vehicle 108 is shown in a further embodiment. Here, a parking spot 156 is occupied by a vehicle 108, triggering sensor 158, which obtains such information as vehicle size or vehicle weight. Sensor/CCTV/camera 160 is installed to provide additional data such as if the parking stall is currently occupied, time of entry and/or exit, and other information.

For purposes of illustration, the data collection devices use some kind of communications network (wired or wireless, for example) to communicate with a parking controller 174. In one embodiment, the sensor/CCTV/camera 160 communicates over wireless communications protocols such as WiFi or Bluetooth® (denoted as wireless communications 166) and is received by antenna 172. In other embodiments, the sensor 158 is connected over wired communications network 168 such as Ethernet.

Various remote devices, such as smartphones 152, may be equipped to transmit and receive (and process) information from the controller 174. In the depicted embodiment, information from various search results or social media posts (shown in screens 154) are gleaned from the smartphones 152 and provided to the controller 174 over wireless communications protocol 166. In addition, an application ("app") 155 may be installed on the smartphone 152 to convey, process, or otherwise facilitate providing information to the controller 174 and/or receiving information (e.g., the decisions made by the controller) in the form of instructions to the driver as one of ordinary skill in the art will appreciate.

Other computing devices, such as desktop 162 may be connected to the controller 174 for providing various information to be used in generating parking-related decisions for a particular parking facility. For example, the calendar entries 164 shown may be analyzed for information to indicate whether the parking demand for a particular facility will be higher on a certain day or at a certain time due to an upcoming event.

Figure 2:
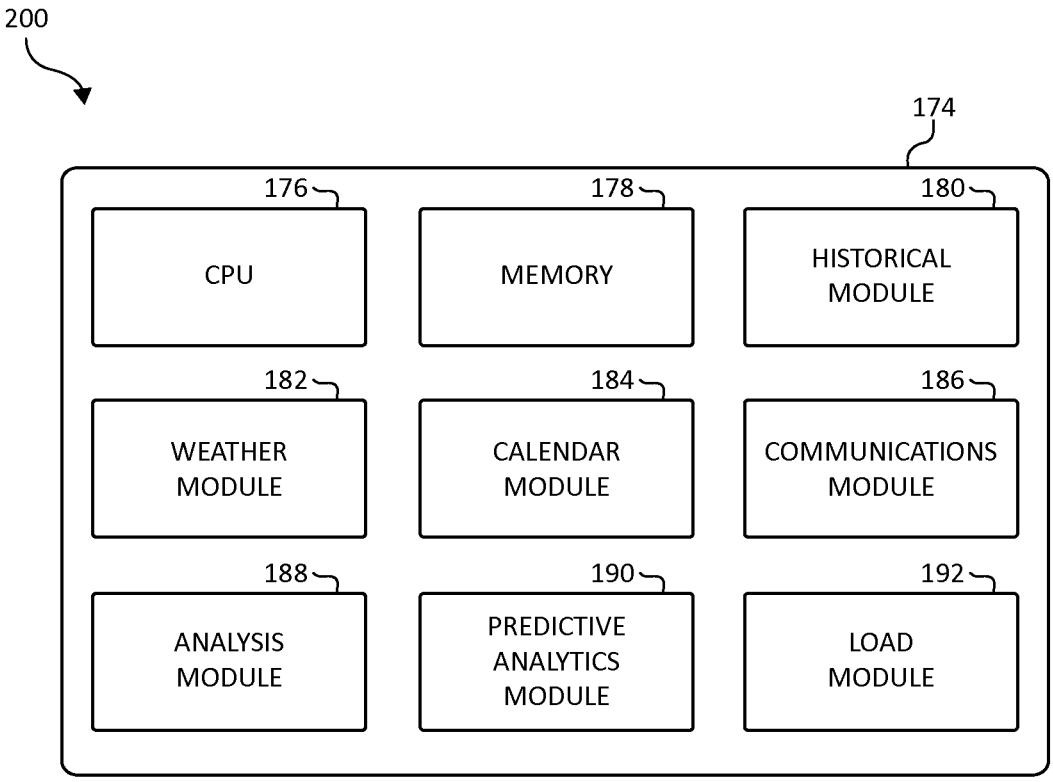
FIG. 2 is a block diagram of exemplary software and hardware components for effecting various aspects of the present invention.

Controller 174 is illustrated in more detail in FIG. 2., following, which is a block diagram of an exemplary embodiment in which various aspects of the present invention may be implemented. Controller 174 includes a Central Processing Unit (CPU) 176, memory 178, a historical module 180, weather module 182, calendar module 184, communications module 186, analysis module 188, predictive analytics module 190, and load module 192.

One of ordinary skill in the art will appreciate that the various components in controller 174 may be implemented in whole, or in part by hardware or software components. The various components depicted in the modules 180, 182, 184, 186, 188, 190, and 192 are separated by function for purposes of convenience; however additional functionality may be implemented and is contemplated to be consistent with each of the aspects of the present invention.

As one of ordinary skill in the art will appreciate, the CPU 176 and memory 178 may undertake certain data processing, data organization and data storage functions. The CPU 176 and memory 178 may assist each of the modules 180, 182, 184, 186, 188, 190, and 192 to accomplish various kinds of functionality. In addition, the CPU 176 and memory 178 may assist in providing return data (e.g., decisions) to individuals via remote device, to various controls of the parking facility itself, to individuals (e.g., attendants) operating the parking facility, or elsewhere.

Historical module 180, in one embodiment, performs various data history functionality. For example, historical module 180 organizes data such as occupancy rates of the facility over time, or individual parking preferences at certain times, dates, or corresponding to historical events or other historical occurrences.

Weather module 182, in one embodiment, performs various weather data collection and monitoring functionality. For example, weather module 182 monitors weather conditions associated with a particular parking facility, such as sunrise, sunset, daylight savings changes, barometric pressure, humidity, wind speed, precipitation, and other data.

Calendar module 184, in one embodiment, performs various calendar data collection and monitoring functionality. For example, calendar module 184 collects and monitors data relating to social media events, calendars, schedules, and other events slated to occur at a particular day or time.

Communications module 186, in one embodiment, performs various communications functionality. For example, communications module 186 may leverage various communication platforms (wireless and/or wired) to send and receive data between the controller 174 and external components, sensors, cameras, remote devices, vehicles, and other hardware.

Analysis module 188, in one embodiment, performs various analysis functionality upon the received and organized data. For example, the analysis module 188 may compare current parking data with historical parking data. Analysis module 188 may compare current temperature data with historical temperature data. Analysis module 188 may perform a wide variety of data analysis upon the various data points obtained from the wide variety of data sources.

Predictive analytics module 190 may, in one embodiment, work in conjunction with analysis module 188 to conduct various predictive analytical functions, so as to generate predictions about individual behavior as applied to a particular parking facility. For example, the predictive analytics module 190 may determine that due to an environmental factor, the parking facility will experience a lesser degree of occupancy, based on historical averages. The predictive analytics module 190 may then assist in generating decisions for the parking structure so as to maximize efficiencies or promote utility to certain users. For example, a section of the parking garage may be closed, saving electricity, security monitoring and other resources.

Finally, load module 192 may, in one embodiment, perform various calculations in regards to the physical operation of the parking facility. For example, based on various data points pertaining to, for example, the number of vehicles in the parking facility, the expected peak occupancy, weather conditions, and other factors, the load module may assist in generating decisions for the parking facility so as to efficiently distribute load across the structure.

Figure 3:
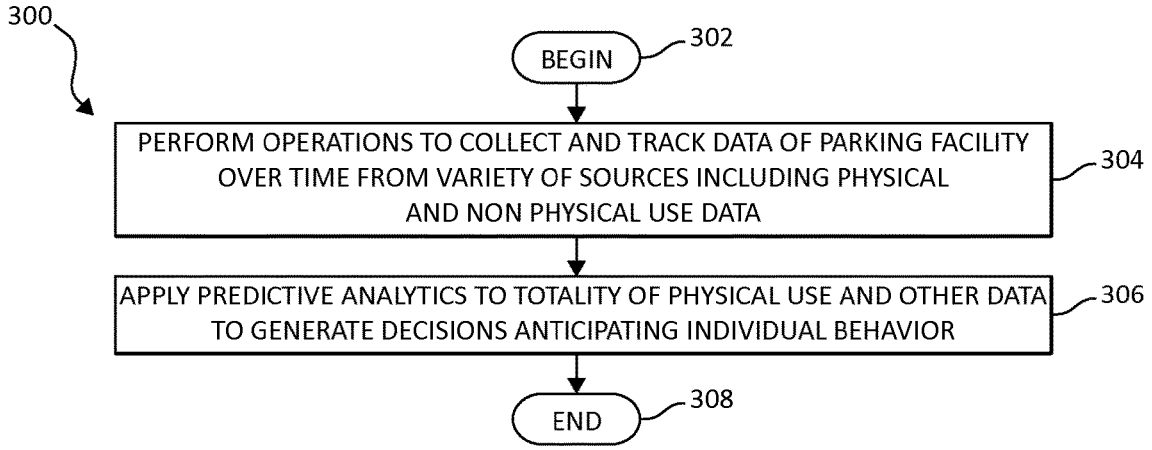
FIG. 3 is a flow chart diagram of an exemplary method for management of a parking facility in accordance with one embodiment of the present invention.

Turning now to FIG. 3, following, an exemplary method 300 for management of a parking facility by a processor is depicted, according to various aspects of the present invention. Method 300 begins (step 302) by performing operations to collect and track data of a particular parking facility over time from a variety of sources including physical use and non physical use data (step 304).

In a following step, predictive analytics are applied to a totality of the physical use and other data to generate decisions anticipating individual behavior concerning the particular parking facility (step 306). The method 300 then ends (step 308).

Figure 4:
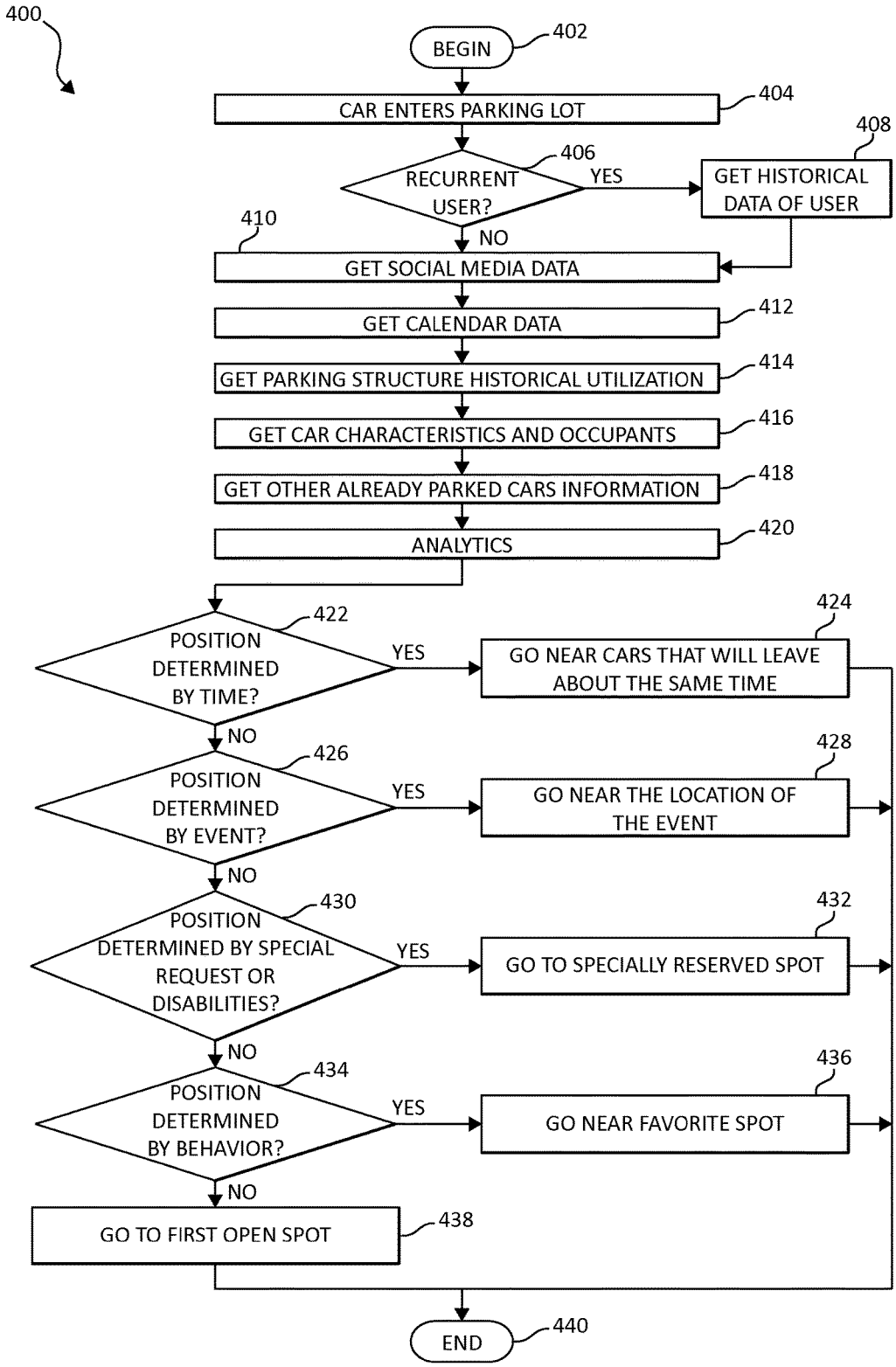
FIG. 4 is a flow chart diagram of an exemplary method for management of a parking facility in accordance with an additional embodiment of the present invention.

The method 300 illustrated in FIG. 3 is supplanted by an additional exemplary method 400 for parking facility management, in which various aspects of the present invention may be implemented, as shown in FIG. 4, following.

Method 400 begins (step 402) with the detection of a vehicle entering the parking facility (step 404). In a following decision step, method 400 queries whether the vehicle is a recurrent user of the facility (step 406). This decision may be performed by checking historical information by the historical module 180 (FIG. 2), or another controller 174 component. If the user is recurrent, the various historical information is obtained (step 308) for analysis.

Returning to step 406, if the user is determined not to be recurrent, the method 400 begins a process of obtaining data from a variety of sources as previously described. For example, the method 400 may obtain information from social media sources (step 410) such as postings, announcements, contests, advertisements, and so forth.

The method 400 may also obtain data from calendar sources (step 412), which may again include announcements, events, calendar entries from a variety of sources (public or personal), and other data. In one embodiment, the social media data and calendar data may be obtained from the user's own personal devices. While step 410 contemplates the obtaining of data from social media, and step 412 contemplates the obtaining of data from calendar sources, one of ordinary skill in the art will appreciate that a wide variety of data from a wide variety of sources may be obtained during this illustrated process. The data have a macro focus, such as an announcement of a rock concert at a nearby venue; or alternatively, the data may have a micro focus, shedding light on a particular user's entries, schedule, preferences, and the like.

Continuing to step 414, the method 400 obtains historical parking facility utilization from the historical module 180 (FIG. 2). The historical parking information may include organized data such as a certain number of vehicles that typically park on that day, or time of day, for example.

In addition, method 400 moves to step 416, which obtains (for example, through sensors, cameras, the availability of public or personal data, or otherwise) the vehicle's characteristics such as size, weight, and model, and characteristics of the occupants of the vehicle, such as whether the vehicle is filled with young children, or adults, and so forth (step 416). Method 400 also obtains, for comparison's sake and other purposes, information from vehicles already parked at the facility (step 418).

The method 400 then moves from the data collection phase to an analytics phase, as first depicted in step 420 and as will be further described in the following example scenario. As part of the predictive analytics functionality, the method 400 undergoes several decision steps outlined here as exemplary decision steps 422, 426, 430, and 434. First, in query 422, the method 400 asks whether the vehicle's position is determined by time (for example, the vehicle is determined to be at the parking facility so the occupants can visit a business during operating hours), then the method 400 moves to step 424, which directs the vehicle (either through facility itself, or through communications to the vehicle and/or a remote device of the user) to a specified parking location where the vehicles will be departing at approximately the same time.

If the position is not determined by time, the method 400 moves to step 426, which queries whether the vehicle position will be determined by some event (for example, the occupants are visiting a nearby restaurant). If so, the method 400 moves to step 428, which directs the vehicle to park near the location of the event, for example.

If the position is not determined by an event, the method 400 moves to decision step 330, which queries whether the position is determined by special requirements and/or disabilities, for example (but also anticipating any other special requirements that the vehicle and/or user may have). If so, the method moves to step 442, where the vehicle is directed to the specifically reserved parking spot.

If the position is not determined by any special requirement, the method 400 moves to step 434, which queries if the vehicle's position is determined by any particular behavior. The anticipated behavior may take, as one of ordinary skill in the art will appreciate, a variety of forms, from individual behavior to group behavior, including anticipated individual preferences, behavior anticipated from past history, behavior anticipated from external factors such as weather or other information, or otherwise. If the position is determined by behavior, then the method 400 directs the vehicle accordingly, such as to the user's favorite parking spot, as depicted in step 336.

In an alternative to any of the decision steps 422, 426, 430, or 434, the method 400 directs the vehicle to the first open spot (or using another predetermined/default methodology for selecting parking locations, for example) in step 338. The method 400 then ends (step 440).

In view of the foregoing, consider the following case example. A particular amusement property has a parking structure methodology where vehicles are parked two at a time, bumper to bumper. While this methodology allows for both vehicles to easily pull in (the first vehicle pulls all the way through, while the second vehicle takes the rear position), if, for example, the user in the first vehicle were to depart shortly after arriving (or even some time after arriving), the odds of the vacated parking pot being filled are low. Utilizing the mechanisms of the illustrated embodiments, the amusement property may implement a "smart" methodology, which predicts which vehicles would leave earlier than others, and therefore issue decisions directing the vehicles anticipated to leave early to take rear parking spots over the front parking spots.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The invention claimed is:

1. A method for management of a parking facility by a processor, comprising:

performing operations to collect and track data of the parking facility over time from a plurality of sources including data representative of physical use of the parking facility and data obtained aside from the physical use data; wherein collecting and tracking data from the plurality of sources includes dynamically collecting and tracking data obtained from calendar entries gleaned from a publicly available source, including a social media source, for at least one of an appointment, a flight, an event, and an attraction; and wherein collecting and tracking data from the plurality of sources further includes deducing, from the calendar entries, a vehicle size and type, and occupant characteristics associated therewith, to be parked at the parking facility; and applying predictive analytics to a totality of the physical use and other data to generate decisions that are implemented for the parking facility, the decisions anticipating individual behavior pertaining to the parking facility.

2. The method of claim 1, wherein collecting and tracking data from the plurality of sources includes at least one of determining an average parking facility utilization from monitoring parking utilization, monitoring a weather condition, determining a preferred parking location, analyzing a traffic pattern including current or planned construction, monitoring a social event, monitoring an hours of operation of a business, analyzing a mobile device search history, and monitoring a holiday schedule.

3. The method of claim 1, wherein applying the predictive analytics includes at least one of considering a total parking capacity of the parking facility, considering a preferred parking location of a vehicle regularly occupying the parking facility, and calculating a parking layout and fill pattern while considering a load balancing requirement of the parking facility.

4. The method of claim 1, wherein applying the predictive analytics further includes considering a past trend of parking structure occupancy to be applied to a current parking scenario having similarly determined characteristics.

5. The method of claim 1, wherein applying the predictive analytics further includes determining at least one of a destination for an occupant of a vehicle parking in the parking facility and a trending departure time for the occupant from the destination.

6. The method of claim 1, wherein applying the predictive analytics further includes communicating, to a remote device, at least one of the decisions for use by at least one of a vehicle and a user for parking in the parking facility.

7. A system for management of a parking facility, comprising:

a processor, wherein the processor:

performs operations to collect and track data of the parking facility over time from a plurality of sources including data representative of physical use of the parking facility and data obtained aside from the physical use data; wherein collecting and tracking data from the plurality of sources includes dynamically collecting and tracking data obtained from calendar entries gleaned from a publicly available source, including a social media source, for at least one of an appointment, a flight, an event, and an attraction; and wherein collecting and tracking data from the plurality of sources further includes deducing, from the calendar entries, a vehicle size and type, and occupant characteristics associated therewith, to be parked at the parking facility; and applies predictive analytics to a totality of the physical use and other data to generate decisions that are implemented for the parking facility, the decisions anticipating individual behavior pertaining to the parking facility.

8. The system of claim 7, wherein the processor, pursuant to collecting and tracking data from the plurality of sources, at least one of determines an average parking facility utilization from monitoring parking utilization, monitors a weather condition, determines a preferred parking location, analyzes a traffic pattern including current or planned construction, monitors a social event, monitors an hours of operation of a business, analyzes a mobile device search history, and monitors a holiday schedule.

9. The system of claim 7, wherein the processor, pursuant to applying the predictive analytics, at least one of considers a total parking capacity of the parking facility, considers a preferred parking location of a vehicle regularly occupying the parking facility, and calculates a parking layout and fill pattern while considering a load balancing requirement of the parking facility.

10. The system of claim 7, wherein the processor, pursuant to applying the predictive analytics, considers a past trend of parking structure occupancy to be applied to a current parking scenario having similarly determined characteristics.

11. The system of claim 7, wherein the processor, pursuant to applying the predictive analytics, determines at least one of a destination for an occupant of a vehicle parking in the parking facility and a trending departure time for the occupant from the destination.

12. The system of claim 7, wherein the processor, pursuant to applying the predictive analytics, communicates, to a remote device, at least one of the decisions for use by at least one of a vehicle and a user for parking in the parking facility.

13. A computer program product for management of a parking facility using a processor, the computer program product comprising a non-transitory computer-readable storage medium having computer-readable program code portions stored therein, the computer-readable program code portions comprising:

a first executable portion that performs operations to collect and track data of the parking facility over time from a plurality of sources including data representative of physical use of the parking facility and data obtained aside from the physical use data; wherein collecting and tracking data from the plurality of sources includes dynamically collecting and tracking data obtained from calendar entries gleaned from a publicly available source, including a social media source, for at least one of an appointment, a flight, an event, and an attraction; and wherein collecting and tracking data from the plurality of sources further includes deducing, from the calendar entries, a vehicle size and type, and occupant characteristics associated therewith, to be parked at the parking facility; and a second executable portion that applies predictive analytics to a totality of the physical use and other data to generate decisions that are implemented for the parking facility, the decisions anticipating individual behavior pertaining to the parking facility.

14. The computer program product of claim 13, further including a third executable portion that, pursuant to collecting and tracking data from the plurality of sources, at least one of determines an average parking facility utilization from monitoring parking utilization, monitors a weather condition, determines a preferred parking location, analyzes a traffic pattern including current or planned construction, monitors a social event, monitors an hours of operation of a business, analyzes a mobile device search history, and monitors a holiday schedule.

15. The computer program product of claim 13, further including a third executable portion that, pursuant to applying the predictive analytics, at least one of considers a total parking capacity of the parking facility, considers a preferred parking location of a vehicle regularly occupying the parking facility, and calculates a parking layout and fill pattern while considering a load balancing requirement of the parking facility.

16. The computer program product of claim 13, further including a third executable portion that, pursuant to applying the predictive analytics, considers a past trend of parking structure occupancy to be applied to a current parking scenario having similarly determined characteristics.

17. The computer program product of claim 13, further including a third executable portion that, pursuant to applying the predictive analytics, determines at least one of a destination for an occupant of a vehicle parking in the parking facility and a trending departure time for the occupant from the destination.

18. The computer program product of claim 13, further including a third executable portion that, pursuant to applying the predictive analytics, communicates, to a remote device, at least one of the decisions for use by at least one of a vehicle and a user for parking in the parking facility.

* * * * *